US009474351B2

(12) United States Patent
Chen

(10) Patent No.: US 9,474,351 B2
(45) Date of Patent: Oct. 25, 2016

(54) COSMETIC APPLICATOR

(71) Applicant: CAPICOLOR INTERNATIONAL COSMETICS LTD., Taichung (TW)

(72) Inventor: Ming-Hung Chen, Taichung (TW)

(73) Assignee: Capicolor International Cosmetics Ltd., Taichung (TW)

( * ) Notice: Subject to any disclaimer, the term of this patent is extended or adjusted under 35 U.S.C. 154(b) by 37 days.

(21) Appl. No.: 14/563,233

(22) Filed: Dec. 8, 2014

(65) Prior Publication Data

US 2016/0157584 A1 Jun. 9, 2016

(51) Int. Cl.

| | |
|---|---|
| ***A45D 40/04*** | (2006.01) |
| ***A45D 40/20*** | (2006.01) |
| ***A45D 40/02*** | (2006.01) |
| ***A45D 40/06*** | (2006.01) |

(52) U.S. Cl.

CPC ..... *A45D 40/205* (2013.01); *A45D 40/02* (2013.01); *A45D 40/04* (2013.01); *A45D 40/06* (2013.01); *A45D 2040/208* (2013.01)

(58) Field of Classification Search

CPC ..... A45D 2040/208; A45D 40/02; A45D 40/04; A45D 40/06

USPC ..... 401/68, 75

See application file for complete search history.

(56) References Cited

U.S. PATENT DOCUMENTS

| | | | | |
|---|---|---|---|---|
| 6,068,421 A * | 5/2000 | Pierpont | ..... | A45D 40/06 220/796 |
| 6,155,734 A * | 12/2000 | Kageyama | ..... | A45D 40/06 401/116 |
| 7,044,667 B2 * | 5/2006 | Tanaka | ..... | A45D 40/04 401/116 |

* cited by examiner

*Primary Examiner* — Jennifer C Chiang
(74) *Attorney, Agent, or Firm* — LeClairRyan

(57) ABSTRACT

A cosmetic applicator includes a head, a tube including a tube body, multiple driving teeth, a rotating sleeve disposed in the head, multiple driven teeth arranged alternately with the driving teeth, and a threaded rod threadedly connected to the rotating sleeve. Each driving tooth has driving and retarding surfaces. An angle formed between the driving surface and the tube body is smaller than that formed between the retarding surface and the tube body. Each driven tooth has driven and contact surfaces. An angle formed between the contact surface and the rotating sleeve is larger than that between the driven surface and the rotating sleeve and is different from that between the retarding surface and the tube body.

9 Claims, 4 Drawing Sheets

COSMETIC APPLICATOR

FIELD OF INVENTION

The invention relates to a cosmetic product, more particularly to a cosmetic applicator.

BACKGROUND OF THE INVENTION

A conventional cosmetic applicator (such as an eyebrow pencil) has a structure similar to that of a pencil, which involves a hollow pencil tube made of wood or a synthetic material fitted with a cosmetic stick. To use this conventional cosmetic applicator, a cutting tool is required to cut off a portion of the pencil tube to expose a portion of the cosmetic stick, which is inconvenient.

Therefore, a conventional rotating cosmetic applicator has arisen in the market to alleviate the aforementioned drawback. However, its rotating mechanism, as disclosed in Taiwanese Utility Model Publication No. 209961 (Taiwanese Utility Model Application No. 082201587), is bi-directionally and freely rotatable. Specifically, an outer casing of the rotating mechanism is rotatable in a rotational rotatable in an opposite rotational direction to retract the cosmetic stick. Therefore, the cosmetic stick may be undesirably retracted during use, which would interrupt application of the cosmetic and cause inconvenience.

SUMMARY OF THE INVENTION

Therefore, the object of the present invention is to provide a cosmetic applicator that can eliminate the aforesaid drawback of the prior art.

According to the present invention, there is provided a cosmetic applicator adapted for retaining a cosmetic core therein. The cosmetic applicator includes a head, a tube and a driving unit. The head includes a front end component and a seat component. The front end component is formed with a first through hole that is adapted for fittingly receiving the cosmetic core. The seat component is formed with a second through hole. The second through hole has a front hole portion that is engaged with a rear end of the front end component, and a rear hole portion that is in spatial communication with the first through hole. The tube includes a tube body that is coupled to the seat component of the head, and a blocking wall that is formed inside the tube body. An inner space of the tube body is in spatial communication with the rear hole portion of the second through hole. The tube body is rotatable about an axis relative to the head. The driving unit includes a plurality of angularly spaced-apart driving teeth, a rotating sleeve, a plurality of driven teeth and a threaded rod. The driving teeth protrude from an inner surface of the tube body, and each adjacent pair of the driving teeth cooperatively defines a tooth-receiving space therebetween. Each of the driving teeth has a driving surface and a retarding surface. An angle formed between the driving surface and the inner surface of the tube body is smaller than an angle formed between the retarding surface and the inner surface of the tube body. The rotating sleeve is disposed in the rear hole portion in front of the blocking wall, is internally threaded, and is rotatable about the axis. The driven teeth protrude from an outer surface of the rotating sleeve, and each of the driven teeth is accommodated in the tooth-receiving space which is defined by a respective adjacent pair of the driving teeth. Each of the driven teeth has a driven surface and a contact surface. An angle formed between the driven surface and the outer surface of the rotating sleeve is smaller than an angle formed between the contact surface and the outer surface of the rotating sleeve. The angle formed between the retarding surface of each of the driving teeth and the inner surface of the tube body is different from the angle formed between the contact surface of each of the driven teeth and the outer surface of the rotating sleeve. The threaded rod is disposed in and threadedly connected to the rotating sleeve, and is adapted to be connected to the cosmetic core.

When the tube is rotated in a rotational direction, the driving surfaces of the driving teeth push respectively against the driven surfaces of the driven teeth to rotate the rotating sleeve, thereby driving forward movement of the cosmetic core along the axis through threaded engagement between the rotating sleeve and the threaded rod.

When the tube is rotated in an opposite rotational direction, the retarding surfaces of the driving teeth contact respectively the contact surfaces of the driven teeth to reversely rotate the rotating sleeve, thereby driving rearward movement of the cosmetic core along the axis through the threaded engagement between the rotating sleeve and the threaded rod.

BRIEF DESCRIPTION OF THE DRAWINGS

Other features and advantages of the present invention will become apparent in the foil owing detailed description of the embodiment with reference to the accompanying drawings, of which.

DETAILED DESCRIPTION OF THE EMBODIMENT

Figure 1:
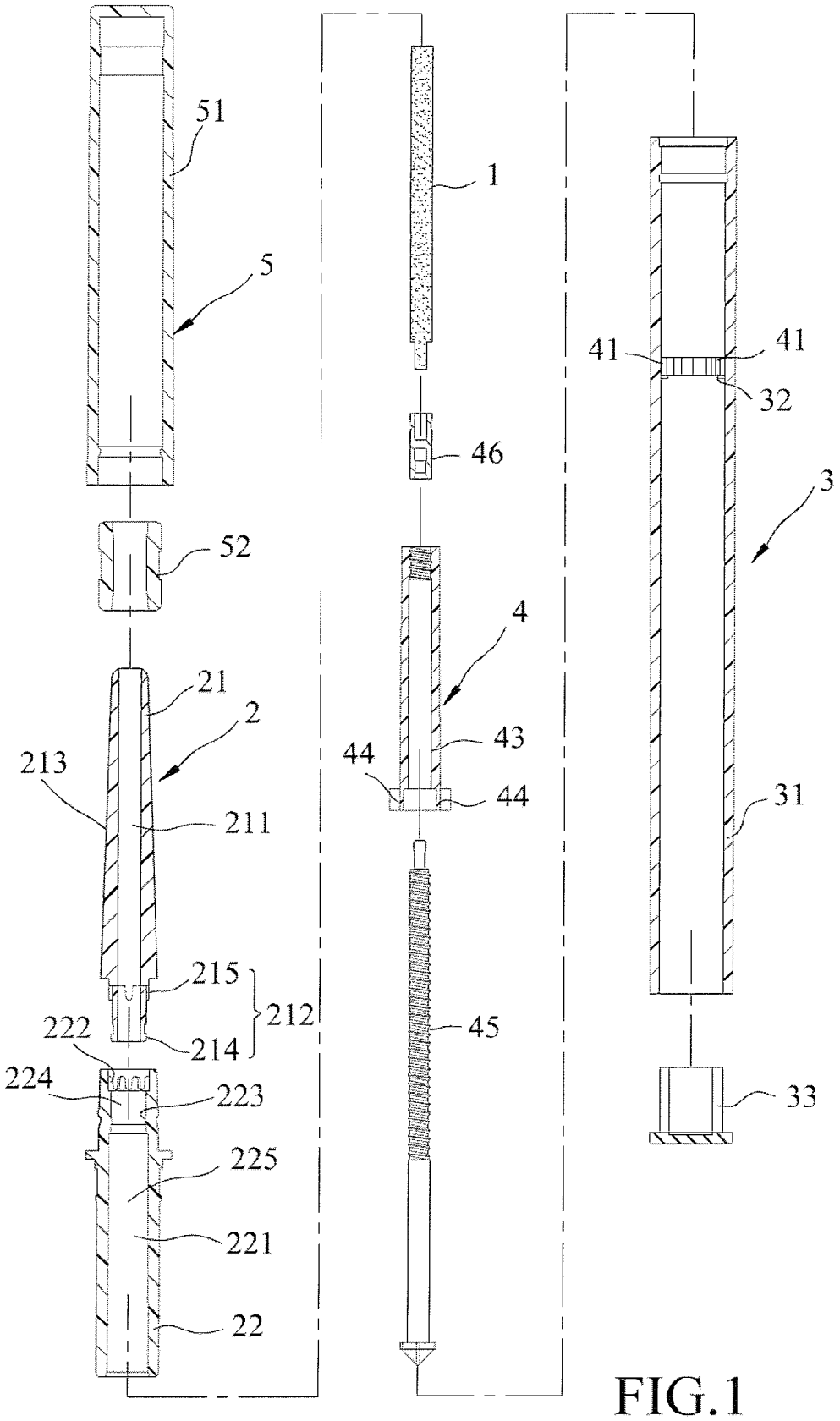
FIG. 1 is an exploded sectional view of an embodiment of a cosmetic applicator according to the present invention.
Figure 2:
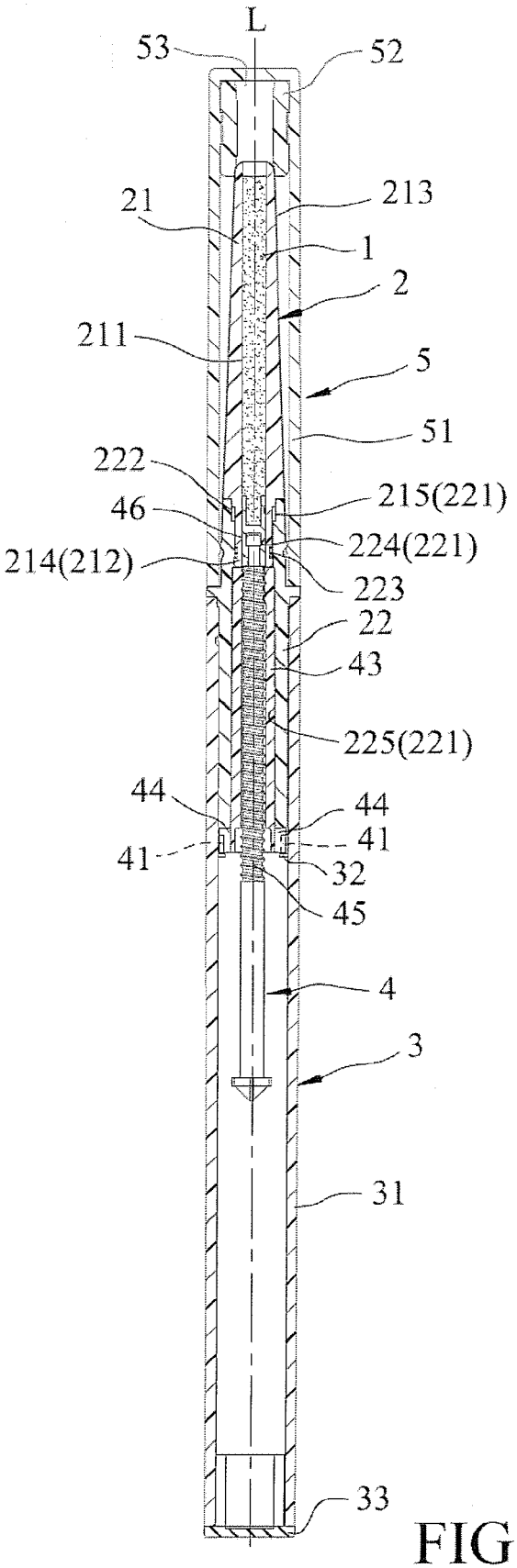
FIG. 2 is an assembled sectional view of the embodiment.
Figure 3:
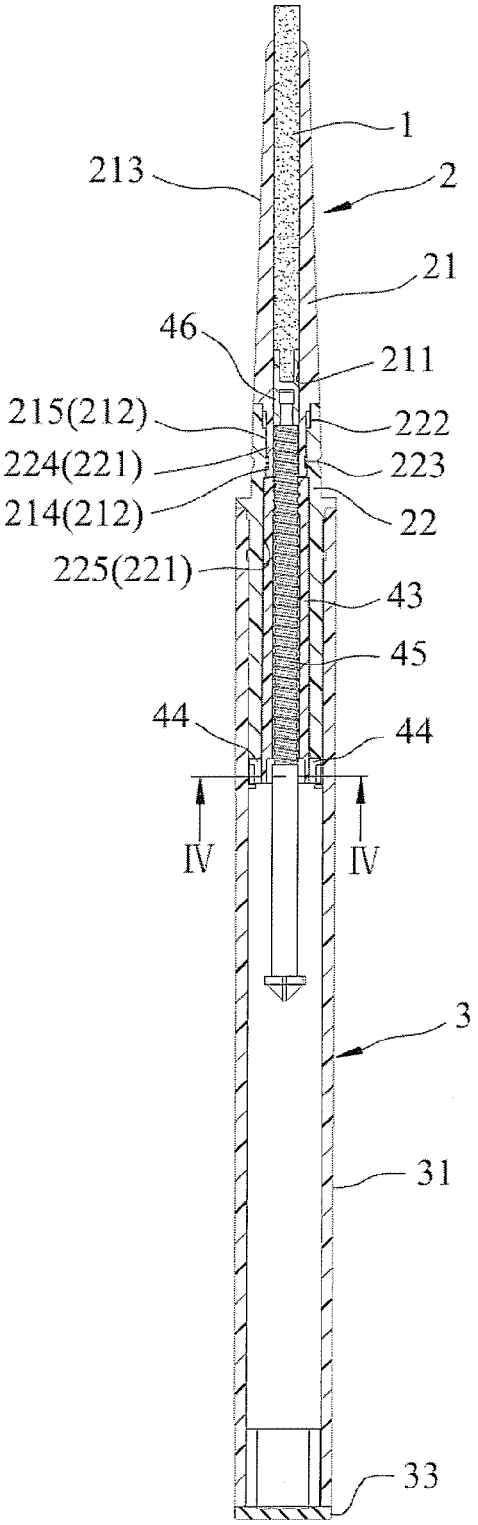
FIG. 3 is an assembled side sectional view illustrating the embodiment in use.

Referring to FIGS. 1 to 3, an embodiment of a cosmetic applicator according to the present invention is adapted for retaining a cosmetic core 1 therein, and includes a head 2, a tube 3, a driving unit 4 and a cap 5.

The head 2 surrounds an axis (L), and includes a front end component 21 and a seat component 22. The front end component 21 is formed with a first through hole 211 that extends along the axis (L) and that is adapted for fittingly receiving the cosmetic core 1, and has an assembling unit 212 that is provided on a rear end of the front end component 21, and an outer surrounding surface 213 that surrounds the axis (L) and converging forwardly along the axis (L). The assembling unit 212 of the front end component 21 has an annular limiting block 214 that is formed on an outer surface of the rear end of the front end component 21, and a corrugated outer protrusion 215 that is formed on the outer surface of the rear end of the front end component 21 and that is spaced apart from the annular limiting block 214 along the axis (L).

The seat component 22 is formed with a second through hole 221, and has a corrugated inner groove 222 and an annular flange 223. The second through hole 221 has a front hole portion 224, and a rear hole portion 225 that is in spatial communication with the front hole portion 224 and the first through hole 211. The inner groove 222 and the annular flange 223 are formed in an inner surface which defines the front hole portion 224 of the second through hole 221, and are spaced apart from each other. The inner groove 222 is engaged with the outer protrusion 215, and the annular flange 223 abuts against the annular limiting block 214, thereby coupling the front end component 21 and the seat component 22 together.

The tube 3 includes a tube body 31, a blocking wall 32 and a plug 33. The tube body 31 is coupled to the seat component 22 of the head 2. The blocking wall 32 is formed inside the tube body 31. The plug 33 is plugged into an end of the tube body 31 that is opposite to the head 2 along the axis (L) to seal an end of the cosmetic applicator. The tube body 31 is rotatable about the axis (L) relative to the head 2 and has an inner space that is in spatial communication with the rear hole portion 225 of the second through hole 221.

Figure 4:
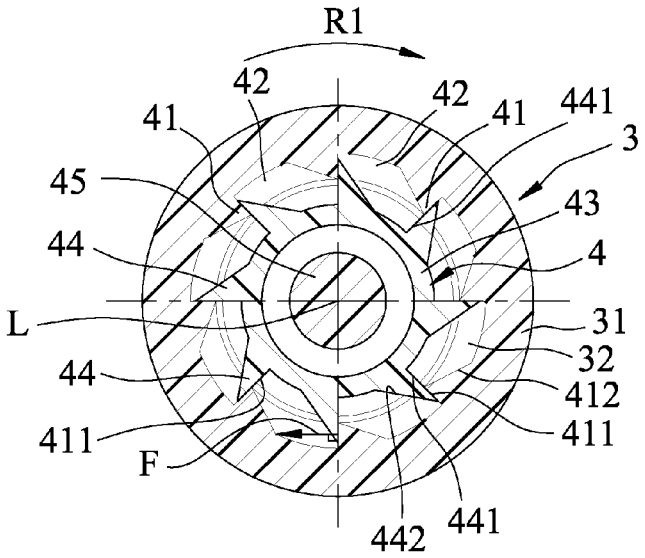
FIG. 4 is a sectional view of the embodiment taken along line IV-IV in FIG. 3, illustrating a tube being rotated in a rotational direction.

Referring to FIGS. 1, 3 and 4, the driving unit 4 includes a plurality of angularly spaced-apart driving teeth 41, a rotating sleeve 43, a plurality of driven teeth 44, a threaded rod 45 and a core seat 46. The driving teeth 41 protrude from an inner surface of the tube body 31, and each adjacent pair of the driving teeth 41 cooperatively define a tooth-receiving space 42 therebetween. The rotating sleeve 43 is disposed in the rear hole portion 225 of the second through hole 221 in front of the blocking wall 32, is internally threaded, and is rotatable about the axis (L). The blocking wall 32 prevents the rotating sleeve 43 from moving rearward along the axis (L) out of the rear hole portion 225 of the second through hole 221. The driven teeth 44 protrude from an outer surface of the rotating sleeve 43, and each of the driving teeth 44 is accommodated in the tooth-receiving space 42 which is de fined by a respective adjacent pair of the driving teeth 41. The threaded rod 45 is disposed in and threadedly connected to the rotating sleeve 43, and is adapted to be connected to the cosmetic core 1. The core seat 46 is disposed in the first through hole 211 of the front end component 21, and is adapted for fixedly interconnecting the threaded rod 45 and the cosmetic core 1. The cosmetic core 1 extends into the second through hole 221 of the seat component 22 and is connected fixedly to the core seat 46.

Referring to FIGS. 1 and 2, the cap 5 includes a cap body 51 coupled removably to the head 2, an airtight cover 52 mounted in the cap body 51, abutting removably against the outer surrounding surface 213 of the front end component 21 of the head 2, and cooperating with the outer surrounding surface 213 to define an airtight chamber 53 that is in spatial communication with the first through hole 211. In this embodiment, the airtight cover 52 is made of a resilient, material.

Figure 5:
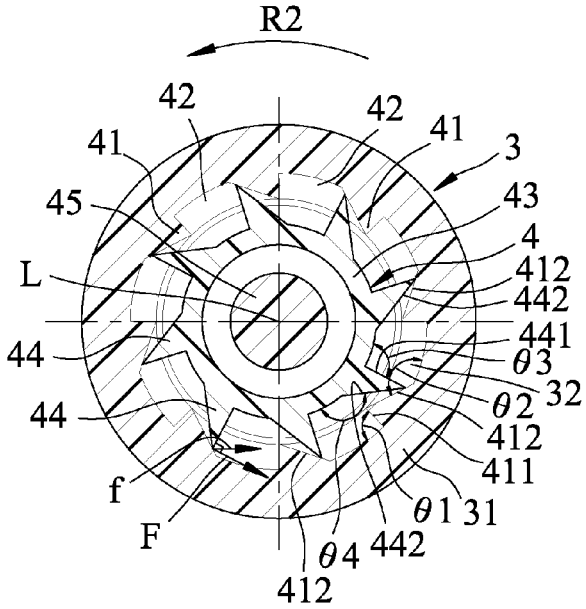
FIG. 5 is a view similar to FIG. 4, but illustrating the tube being rotated in an opposite rotational direction.

Referring back to FIG. 4, with further reference to FIG. 5, each of the driving teeth 41 has a driving surface 411 and a retarding surface 412. An angle (θ1) formed between the driving surface 411 and an immediately adjacent section of the inner surface of the tube body 31 is smaller than an angle (θ2) formed between the retarding surface 412 and an immediately adjacent section of the inner surface of the tube body 31. Each of the driven teeth 44 has a driven surface 441 and a contact surface 442. An angle (θ3) formed between the driven surface 441 and an immediately adjacent section of the outer surface of the rotating sleeve 43 is smaller than an angle (θ4) formed between the contact surface 442 and an immediately adjacent section of the outer surface of the rotating sleeve 43.

In this embodiment, the driving surfaces 411 of the driving teeth 41 extend radially from the tube body 31 with respect to the axis (L). The angle (θ2) formed between the retarding surface 412 of each of the driving teeth 41 and the immediately adjacent section of the inner surface of the tube body 31 is an obtuse angle. The driven surfaces 441 of the driven teeth 44 extend radially from the rotating sleeve 43 with respect to the axis (L). The angle (θ4) formed between the contact surface 442 of each of the driven teeth 44 and the immediately adjacent section of the outer surface of the rotating sleeve 43 is an obtuse angle. In this embodiment, the obtuse angle (θ2) formed between the retarding surface 412 of each of the driving teeth 41 and the immediately adjacent section of the inner surface of the tube body 31 is different from the obtuse angle (θ4) formed between the contact surface 442 of each of the driven teeth 44 and the immediately adjacent section of the outer surface of the rotating sleeve 43.

As a force (F) is exerted to rotate the tube 3 in a rotational direction (R1) (see FIG. 4), the driving surfaces 411 of the driving teeth 41 are respectively brought into planar contact with the driven surfaces 441 of the driven teeth 44 and subsequently push respectively the driven surfaces 441 to bring about rotation the rotating sleeve 43, thereby driving forward movement of the cosmetic core 1 (see FIG. 2) along the axis (L) through threaded engagement between the rotating sleeve 43 and the threaded rod 45.

When the force (F) is exerted to rotate the tube 3 in an opposite rotational direction (R2) (see FIG. 5), the retarding surfaces 412 of the driving teeth 41 are respectively brought into linear, instead of planar, contact with the contact surfaces 442 of the driven teeth 44 due to the different obtuse angles (θ2, θ4), and subsequently push respectively the contact surfaces 442 so as to bring about reverse rotation of the rotating sleeve 43, thereby driving rearward movement of the cosmetic core 1 along the axis (L) through the threaded engagement between the rotating sleeve 43 and threaded rod 45. However, the use of the same amount of force (F) in rotating the tube 3 in different rotational directions will generate different results. During rotation of the tube 3 in the rotational direction (R1), since the driving surfaces 411 are respectively in planar contact with the driven surfaces 441 and since the driving surfaces 411 of the driving teeth 41 and the driven surfaces 441 of the driven teeth 44 all extend in radial directions, the driven surfaces 441 are pushed by the entire force (F), whereas during rotation of the tube 3 in the opposite rotational direction (R2), only a component force (f) of the force (F) contributes to pushing the contact surfaces 442 since the retarding surfaces 412 of the driving teeth 41 and the contact surfaces 442 of the driven teeth 44 are inclined at different degrees relative to the radial directions so that only linear contacts may be made between the retarding surfaces 412 and the contact surfaces 442. In other words, in order to effectively retract the cosmetic core 1, a greater force is required to rotate the tube 3 in the opposite rotational direction (R2), so that undesirable retraction of the cosmetic core 1 during use can be prevented.

From the foregoing, the advantages of the present invention are summarized as follows.

1) By virtue of the configurations of the driving teeth 41 and the driven teeth 44, a user can easily rotate the tube 3 and drive the cosmetic core 1 out of the cosmetic applicator, and undesirable retraction of the cosmetic core 1 during use can be prevented.

2) When the cosmetic applicator is not in use, the airtight cover 52 of the cap 5 is used to prevent volatilization of volatile substances, if any, in the cosmetic core 1, which would otherwise result in hardening of the cosmetic core 1, thereby lengthening the service life of the cosmetic core 1.

3) Since the head 2 is made up of the front end component 21 and the seat component 22 instead of being formed as an elongated single-piece element, the chances of forming air bubbles within the head 2 during injection molding process can be lowered.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cosmetic applicator adapted for retaining a cosmetic core therein, said cosmetic applicator comprising:

a head including a front end component formed with a first through hole that is adapted for fittingly receiving the cosmetic core, and a seat component formed with a second through hole, said second through hole having a front hole portion that is engaged with a rear end of said front end component, and a rear hole portion that is in spatial communication with said first through hole;

a tube including a tube body that is coupled to said seat component of said head, and a blocking wall that is formed inside said tube body, an inner space of said tube body being in spatial communication with said rear hole portion of said second through hole, said tube body being rotatable about an axis relative to said head; and a driving unit including a plurality of angularly spaced-apart driving teeth that protrude from an inner surface of said tube body, each adjacent pair of said driving teeth cooperatively defining a tooth-receiving space therebetween, each of said driving teeth having a driving surface and a retarding surface, an angle formed between said driving surface and said inner surface of said tube body being smaller than an angle formed between said retarding surface and said inner surface of said tube body, a rotating sleeve that is disposed in said rear hole portion in front of said blocking wall, that is internally threaded, and that is rotatable about the axis, a plurality of driven teeth that protrude from an outer surface of said rotating sleeve, each of said driven teeth being accommodated in said tooth-receiving space which is defined by a respective adjacent pair of said driving teeth, each of said driven teeth having a driven surface and a contact surface, an angle formed between said driven surface and said outer surface of said rotating sleeve being smaller than an angle formed between said contact surface and said outer surface of said rotating sleeve, the angle formed between said retarding surface of each of said driving teeth and said inner surface of said tube body being different from the angle formed between said contact surface of each of said driven teeth and said outer surface of said rotating sleeve, and a threaded rod that is disposed in and threadedly connected to said rotating sleeve, and that is adapted to be connected to the cosmetic core;

wherein, when said tube is rotated in a rotational direction, said driving surfaces of said driving teeth push respectively against said driven surfaces of said driven teeth to rotate said rotating sleeve, thereby driving forward movement of the cosmetic core along the axis through threaded engagement between said rotating sleeve and said threaded rod; and wherein, when said tube is rotated in an opposite rotational direction, said retarding surfaces of said driving teeth contact respectively said contact surfaces of said driven teeth to reversely rotate said rotating sleeve, thereby driving rearward movement of the cosmetic core along the axis through the threaded engagement between said rotating sleeve and said threaded rod.

2. The cosmetic applicator as claimed in claim 1, wherein said front end component has an annular limiting block that is formed on an outer surface of said rear end of said front end component, and an outer protrusion that is formed on said outer surface of said rear end of said front end component and that is spaced apart from said annular limiting block; and said seat component has an inner groove that is formed in an inner surface of a front end of said seat component, and that is engaged with said outer protrusion, and an annular flange that is formed in said inner surface of a front end of said seat component, and that abuts against said annular limiting block.

3. The cosmetic applicator as claimed in claim 1, wherein said driving surfaces of said driving teeth extend radially from said tube body with respect to the axis;

the angle formed between said retarding surface of each of said driving teeth and said inner surface of said tube body is an obtuse angle;

said driven surfaces of said driven teeth extend radially with respect to the axis from said rotating sleeve; and the angle formed between said contact surface of each of said driven teeth and said outer surface of said rotating sleeve is an obtuse angle.

4. The cosmetic applicator as claimed in claim 1, wherein said tube further includes a plug plugged into an end of said tube body that is opposite to said head along the axis.

5. The cosmetic applicator as claimed in claim 1, further comprising a cap that is coupled removably to said head and that cooperates with said head to define an airtight chamber being in spatial communication with said first through hole.

6. The cosmetic applicator as claimed in claim 5, wherein said cap includes a cap body coupled removably to said head, and an airtight cover mounted in said cap body and defining said airtight chamber.

7. The cosmetic applicator as claimed in claim 6, wherein said front end component of said head has an outer surrounding surface surrounding the axis and converging forwardly along the axis, said airtight cover abutting removably against said outer surrounding surface.

8. The cosmetic applicator as claimed in claim 6, wherein said airtight cover is made of a resilient material.

9. The cosmetic applicator as claimed in claim 1, wherein said driving unit further includes a core seat disposed in said first through hole of said front end component, and adapted for fixedly interconnecting said threaded rod and the cosmetic core.

* * * * *